US008655239B2

(12) United States Patent
Mizoguchi et al.

(10) Patent No.: US 8,655,239 B2
(45) Date of Patent: Feb. 18, 2014

(54) TRANSFER BELT UNIT AND IMAGE FORMING APPARATUS

(75) Inventors: Fumito Mizoguchi, Osaka (JP); Toshiki Takiguchi, Osaka (JP); Hideshi Izumi, Osaka (JP); Hiroshi Tachiki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 35 days.

(21) Appl. No.: 13/438,334

(22) Filed: Apr. 3, 2012

(65) Prior Publication Data

US 2012/0251198 A1 Oct. 4, 2012

(30) Foreign Application Priority Data

Apr. 4, 2011 (JP) ..... 2011-082966

(51) Int. Cl.
*G03G 15/20* (2006.01)

(52) U.S. Cl.
USPC ..... 399/313

(58) Field of Classification Search
USPC ..... 399/302, 308, 313, 303
See application file for complete search history.

(56) References Cited

U.S. PATENT DOCUMENTS

| | | | | |
|---|---|---|---|---|
| 7,224,932 | B2 * | 5/2007 | Omata | 399/400 |
| 7,809,317 | B2 * | 10/2010 | Someya et al. | 399/307 |
| 8,107,849 | B2 * | 1/2012 | Tomura et al. | 399/101 |
| 2002/0159800 | A1 | 10/2002 | Suzuki et al. | |
| 2005/0265755 | A1 * | 12/2005 | Takahashi | 399/302 |

FOREIGN PATENT DOCUMENTS

| | | | |
|---|---|---|---|
| JP | 02-226281 | A | 9/1990 |
| JP | 06-138725 | A | 5/1994 |
| JP | 09-015993 | A | 1/1997 |
| JP | 11-095565 | A | 4/1999 |
| JP | 11-109826 | A | 4/1999 |
| JP | 2001-192136 | | 7/2001 |
| JP | 2002-244448 | A | 8/2002 |
| JP | 2007178750 | A * | 7/2007 |

* cited by examiner

*Primary Examiner* — Robert Beatty
(74) *Attorney, Agent, or Firm* — Renner, Otto, Boisselle & Sklar, LLP

(57) ABSTRACT

A secondary transfer unit stretches a transfer belt in an endless form over a driving roller, a driven roller, a transfer roller, an auxiliary roller, and a support roller therebetween. The transfer belt moves, by rotation of the driving roller, along a circulation path which passes through a transfer position. The transfer roller and the auxiliary roller press the transfer belt from the inner peripheral surface of the transfer belt toward an intermediate transfer belt in the transfer position. The transfer belt has an outer peripheral surface thereof which is pressed against the intermediate transfer belt and is roughened so that the surface roughness of the outer peripheral surface becomes 6 μm to 10 μm.

5 Claims, 3 Drawing Sheets

FIG.3

| LIFE SPAN | Rz = 6μm | Rz = 1μm |
|---|---|---|
| EARLY STAGE | △ | × |
| MIDDLE STAGE | ○ | △ |
| FINAL STAGE | ◎ | ○ |
| EVALUATION | OK | NG |

TRANSFER BELT UNIT AND IMAGE FORMING APPARATUS

CROSS REFERENCE

This Nonprovisional application claims priority under 35 U.S.C. §119(a) on Patent Application No. 2011-082966 filed in Japan on Apr. 4, 2011, the entire contents of which are hereby incorporated by reference.

BACKGROUND OF THE INVENTION

The present invention relates to a transfer belt unit used in an electrophotographic image forming apparatus and also relates to an image forming apparatus provided with such a transfer belt unit.

An electrophotographic image forming apparatus forms a toner image on a surface of an image bearing member such as a photoreceptor drum or an intermediate transfer belt, and transfers the toner image onto a sheet by a transfer means. Some image forming apparatuses are provided with a transfer belt unit including an endless transfer belt as the transfer means.

The transfer belt unit is configured to stretch the endless transfer belt over a plurality of rollers including a driving roller and a transfer roller. The driving roller receives rotation supplied from a driving source. The transfer belt is pressed against the image bearing member with the transfer belt held therebetween in a transfer position, and forms a transfer electric field by means of a transfer bias being applied from a power supply portion. The transfer belt moves along a predetermined circulation path by rotation of the driving roller. The transfer belt of which circulation path includes a part of a sheet feed path which passes through a transfer position, has a function of a conveyor belt to convey a sheet via the transfer position.

In order to correctly transfer a toner image on the surface of the image bearing member onto a sheet, it is necessary to synchronize a conveying speed of the sheet in the transfer position with a moving speed of the surface of the image bearing member, and it is also necessary to stably move the transfer belt at a constant speed. A conveyor belt which has a function of conveying a sheet within the image forming apparatus is formed in a plane shape, using resin as a material and setting an outer peripheral surface and an inner peripheral surface as mirror surfaces, so that a slip easily occurs between the conveyor belt and the driving roller, which may cause a case where it is difficult to move the conveyor belt stably at a constant speed.

For this reason, as disclosed in Japanese Patent Laid-Open Publication No. 2001-192136, for example, some conventional conveyor belts made of resin have a roughened inner peripheral surface in contact with a peripheral surface of the driving roller. The configuration is regarded to be capable of preventing the slip by increasing friction between the conveyor belt and the driving roller and also moving the conveyor belt at a constant speed.

Thus, roughening the inner peripheral surface of the transfer belt is considered to be capable of: eliminating the slip between the transfer belt and the driving roller, moving the transfer belt while synchronizing with a peripheral speed of the driving roller, and also conveying a sheet stably at a constant speed.

However, in a case of roughening the inner peripheral surface of the transfer belt, keeping the outer peripheral surface of the transfer belt pressed against the image bearing member as a mirror surface may cause vibration of the transfer belt by friction between the image bearing member and the outer peripheral surface of the transfer belt, the friction being caused by errors of the diameter of the driving roller or the thickness of the transfer belt. If such a state is left as it is, a sheet which passes through the transfer position will move slightly forward and backward, which may prevent a toner image from being transferred correctly from the image bearing member onto the sheet, and thereby causes deterioration of an image formed on the sheet. Such a problem may also be caused in a case where the inner peripheral surface of the transfer belt is a mirror surface.

In view of the foregoing problems, it is an object of the present invention is to provide a transfer belt unit capable of preventing occurrence of vibration of the transfer belt due to friction with an image bearing member and correctly transferring a toner image onto a sheet conveyed in a transfer position through the transfer belt, and to also provide an image forming apparatus provided with such a transfer belt unit.

SUMMARY OF THE INVENTION

A transfer belt unit according to the present invention is provided with a transfer belt, a plurality of rollers including a driving roller and a transfer roller, and a driving source. The transfer belt is an endless belt, made of resin, which moves along a circulation path which passes through a transfer position. The plurality of rollers stretch the transfer belt therebetween. The driving source supplies rotation to the driving roller. The transfer roller presses, in the transfer position, the transfer belt from an inner peripheral surface of the transfer belt toward an image bearing member. The transfer belt has a roughened outer peripheral surface thereof in contact with the image bearing member.

The foregoing and other features and attendant advantages of the present invention will become more apparent from the reading of the following detailed description of the invention in conjunction with the accompanying drawings.

BRIEF DESCRIPTION OF THE DRAWINGS

FIG. 3 is a view showing an experimental result of the relationship between surface roughness of an outer peripheral surface in the secondary transfer unit and image quality on a sheet.

DETAILED DESCRIPTION OF THE INVENTION

Hereinafter, an image forming apparatus incorporating therein a transfer belt unit according to an embodiment of the present invention will be described with reference to the attached drawings.

Figure 1:
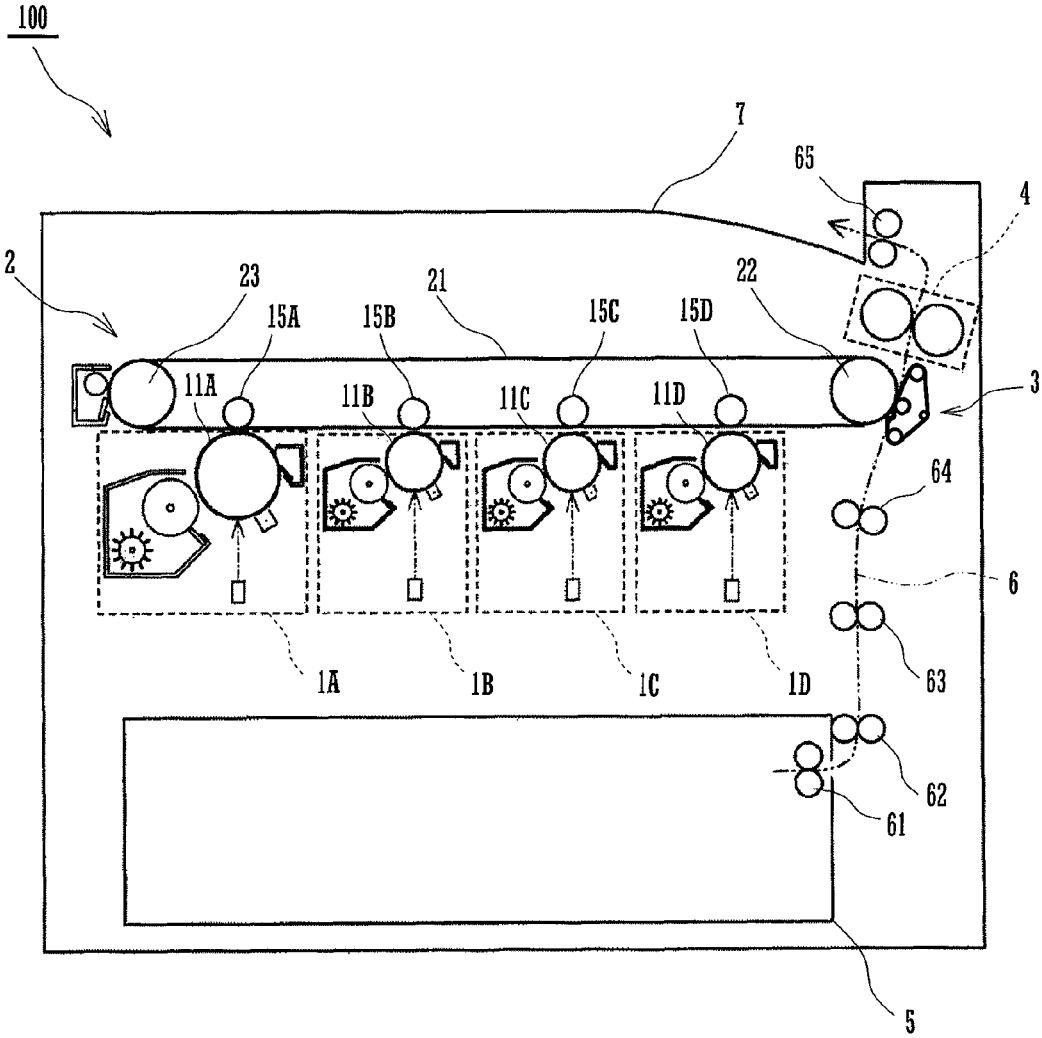
FIG. 1 is a schematic view of an image forming apparatus incorporating therein a secondary transfer unit according to an embodiment of the present invention.

An image forming apparatus 100 illustrated in FIG. 1 is configured to form a polychrome or monochrome image on a sheet by performing an electrophotographic image forming process. The image forming apparatus 100 has therein image forming units 1A to 1D, an intermediate transfer unit 2, a secondary transfer unit 3, a fixing unit 4, a sheet feed cassette 5, and a sheet feed path 6, and also includes a sheet output tray 7 on an upper surface thereof.

The image forming units 1A to 1D form a black toner image, a cyan toner image, a magenta toner image, and a yellow toner image, respectively, on the surfaces of photoreceptor drums 11A to 11D based on image data.

The intermediate transfer unit 2 is provided with an intermediate transfer belt 21, a driving roller 22, a driven roller 23, and transfer rollers 15A to 15D. The intermediate transfer belt 21 in an endless form, corresponding to an image bearing member of the present invention, is stretched over the driving roller 22 and the driven roller 23, and moves by rotation of the driving roller 22 along a circulation path through the image forming units 1A to 1D in this order.

Each of the transfer rollers 15A to 15D of the image forming units 1A to 1D is arranged in a position where the rollers and the photoreceptor drums 11A to 11D hold the intermediate transfer belt 21 therebetween. A toner image formed on the surface of the photoreceptor drums 11A to 11D is primarily transferred to an outer peripheral surface of the intermediate transfer belt 21 by a transfer electric field formed by the transfer rollers 15A to 15D.

The secondary transfer unit 3 is disposed in a position as opposed to the driving roller 22 with the intermediate transfer belt 21 held therebetween. The sheet feed cassette 5 is disposed at a lower part of the image forming units 1A to 1D, and stores a plurality of sheets. The sheet feed path 6 is provided with a sheet feed roller 61, conveyance rollers 62 and 63, a registration roller 64, and a sheet output roller 65, and conveys sheets one by one from the sheet feed cassette 5 up to the sheet output tray 7 by passing between the driving roller 22 and the secondary transfer units 3 and through the fixing unit 4.

The toner image which is primarily transferred to the outer peripheral surface of the intermediate transfer belt 21 is secondarily transferred to a sheet being conveyed in the sheet feed path 6 by the secondary transfer unit 3. The sheet to which the toner image has been transferred is heated and pressurized in the fixing unit 4 and is output to the sheet output tray 7 after the toner image is fixed on the surface of the sheet.

Figure 2:
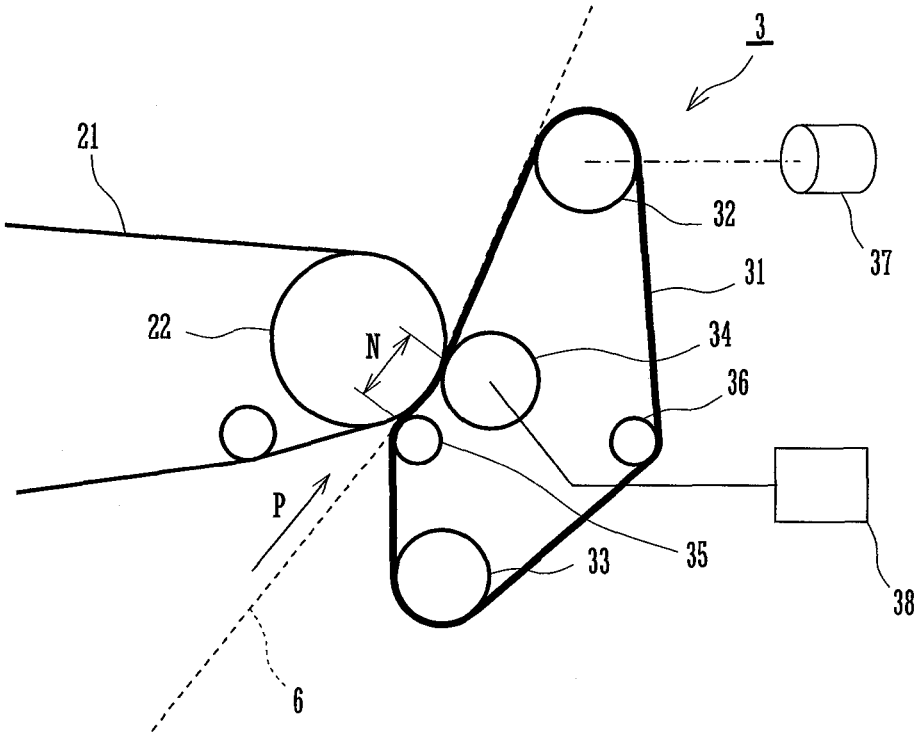
FIG. 2 is a view showing a configuration of the secondary transfer unit.

As shown in FIG. 2, the secondary transfer unit 3 corresponding to a transfer belt unit of the present invention is provided with a transfer belt 31, a driving roller 32, a driven roller 33, a transfer roller 34, an auxiliary roller 35, a support roller 36, a motor 37, and a power source 38.

The transfer belt 31 is a seamless endless belt made of dielectric resin, such as polyethylene terephthalate resin, polyvinylidene fluoride resin, and polyurethane resin. The transfer belt 31 is stretched over a plurality of the rollers such as the driving roller 32, the driven roller 33, the transfer roller 34, the auxiliary roller 35, and the support roller 36.

The driving roller 32 is rotated in response to rotation supplied by the motor 37 corresponding to a driving source of the present invention. The transfer belt 31 moves, by rotation of the driving roller 32, along the circulation path specified by the plurality of rollers. The circulation path includes a secondary transfer position N corresponding to a transfer position of the present invention. With movement of the transfer belt 31, the driven roller 33, the transfer roller 34, the auxiliary roller 35, and the support roller 36 are rotated by rotation of the driving roller 32.

Transfer bias is applied from the power source 38 to the transfer roller 34 to form the transfer electric field between the transfer roller 34 and the intermediate transfer belt 21. The transfer roller 34 presses the transfer belt 31 from the inner peripheral surface of the transfer belt 31 toward the driving roller 22.

The auxiliary roller 35 is arranged at the upstream of the transfer roller 34 in the sheet feed direction P in the sheet feed path 6. The auxiliary roller 35 presses the transfer belt 31 from the inner peripheral surface of the transfer belt 31 toward the driving roller 22.

A single frame for pivotally supporting the driving roller 32, the driven roller 33, the transfer roller 34, the auxiliary roller 35, and the support roller 36 is, for example, freely rotatably supported around the center position of the driving roller 32. Only during image formation, the frame is pivotally moved in a direction where the transfer roller 34 and the auxiliary roller 35 approach the driving roller 22.

The outer peripheral surface of the transfer belt 31 is pressed against the outer peripheral surface of the intermediate transfer belt 21 within a range of the secondary transfer position N. During the image formation, the transfer belt 31, by moving inside of the circulation path, conveys the sheet in the sheet feed path 6 via the secondary transfer position N.

The endless belt made of resin used as the raw material of the transfer belt 31 has the outer peripheral surface and the inner peripheral surface which are mirror surfaces having ten-point average surface roughness Rz of approximately 1 μm to 3 μm. At least the outer peripheral surface of the transfer belt 31 is roughened so as to be set to Rz=6 μm to 10 μm.

During the image formation, the outer peripheral surface of the transfer belt 31 is pressed against the outer peripheral surface of the intermediate transfer belt 21 which moves by rotation of the driving roller 22 with a sheet held therebetween. In the range of the secondary transfer position N, between after the transfer belt 31 is separated from the peripheral surface of the auxiliary roller 35 and until the transfer belt 31 contacts the peripheral surface of the transfer roller 34, the transfer belt 31 is not pressed toward the side of the intermediate transfer belt 21, and is not restricted to move in a direction away from the intermediate transfer belt 21.

If the outer peripheral surface of the transfer belt 31 remains a mirror surface (Rz=1 μm), as shown in FIG. 3, especially in an early stage of the life span of the transfer belt 31, irregularities in an image are easily caused on a sheet, the irregularities being called as pitch spots. The pitch spots are considered to be caused by vibration of the transfer belt 31 in the secondary transfer position N, especially in an area where movement in the direction away from the intermediate transfer belt 21 is not restricted.

In contrast, when the outer peripheral surface of the transfer belt 31 is roughened to Rz=6 μm, the movement of the transfer belt 31 in the secondary transfer position N is stabilized, and generation of the pitch spots has been improved over the whole term of the life span of the transfer belt 31. The same result was also obtained in a case where the outer peripheral surface of the transfer belt 31 was roughened to Rz=10 μm.

It is to be noted that the auxiliary roller 35 may be omitted on condition that the secondary transfer position N which is long enough for transfer of a toner image can be secured. In addition, the transfer belt 31 may also have an roughened inner peripheral surface as well as the roughened outer peripheral surface. Furthermore, the present invention can be similarly applied to a transfer belt unit in which the transfer belt 31 contacts on the surface of the photoreceptor drum. Moreover, the image forming apparatus 100 may be provided with other functions such as an image reading function.

The above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

What is claimed is:

1. A transfer belt unit for moving an endless transfer belt made of resin along a circulation path passing through a transfer position and for transferring a toner image which is formed on a surface of an image bearing member in the transfer position onto a sheet which passes between the image bearing member and the transfer belt, comprising:

a plurality of rollers including a driving roller and a transfer roller, for stretching the transfer belt over the rollers;

a driving source for supplying rotation to the driving roller, wherein:

the transfer roller presses, in the transfer position, the transfer belt from an inner peripheral surface of the transfer belt toward the image bearing member, the transfer belt has an outer peripheral surface of the belt in contact with the image bearing member, and the outer peripheral surface is roughened so as to be set to Rz=6 μm to 10 μm.

2. The transfer belt unit according to claim 1, further comprising an auxiliary roller for pressing the transfer belt against the image bearing member from the inner peripheral surface of the transfer belt with the transfer belt held between the image bearing member and the transfer belt at an upstream of the transfer roller in a moving direction of the image bearing member.

3. The transfer belt unit according to claim 1, wherein the inner peripheral surface of the transfer belt is roughened.

4. An image forming apparatus comprising:

the transfer belt unit according to claim 1; and an image forming portion for forming a toner image on a surface of the image bearing member by an electrophotographic image forming process.

5. The image forming apparatus according to claim 4, wherein the image forming portion includes an intermediate transfer belt as the image bearing member.

* * * * *